United States Patent [19]

Gressett, Jr. et al.

[11] Patent Number: 4,982,986

[45] Date of Patent: Jan. 8, 1991

[54] LEVER/KNOB ACTUATED ENTRY MECHANISM

[75] Inventors: Charles A. Gressett, Jr., Eagle Rock; Gregg L. Smith, Long Beach, both of Calif.

[73] Assignee: Adams Rite Manufacturing Company, City of Industry, Calif.

[21] Appl. No.: 444,412

[22] Filed: Dec. 1, 1989

Related U.S. Application Data

[63] Continuation-in-part of Ser. No. 382,414, Jul. 20, 1989, which is a continuation-in-part of Ser. No. 286,178, Dec. 19, 1988, Pat. No. 4,915,432.

[51] Int. Cl.[5] ..... E05C 1/16

[52] U.S. Cl. ..... 292/336.3; 292/165; 292/244

[58] Field of Search ..... 292/221, 92, 199, 336.3, 292/244, 245, 21, 165

[56] References Cited

U.S. PATENT DOCUMENTS

| | | | |
|---|---|---|---|
| 1,213,651 | 1/1917 | Johns | 292/199 X |
| 2,243,772 | 5/1941 | Peltier | 292/221 X |
| 2,993,358 | 7/1961 | Craig | 292/221 X |
| 3,011,330 | 12/1961 | Eads | 70/100 |
| 3,011,817 | 12/1961 | Eads | 292/140 |
| 3,214,947 | 11/1965 | Wickkerink | 292/92 X |
| 3,368,374 | 2/1968 | Eads | 70/100 |
| 3,689,159 | 3/1975 | Eads | 250/232 |
| 4,003,593 | 1/1977 | Wilzig et al. | 292/92 |
| 4,052,092 | 10/1977 | Bergen | 292/358 X |
| 4,218,903 | 8/1980 | Eads | 70/107 |
| 4,458,928 | 7/1984 | Hirschbein | 292/92 |
| 4,790,583 | 12/1988 | Tonsmann et al. | 292/336.3 |

FOREIGN PATENT DOCUMENTS

| | | | |
|---|---|---|---|
| 1300293 | 6/1962 | France | 292/199 |

OTHER PUBLICATIONS

See U.S. patent application, Ser. No. 237,182, filed Aug. 29, 1988.

Von Duprin, "Exit Devices Touchbar/Crossbar", (pp. 1–5).

Monarch Hardware, 08716–MON, BuyLine 1293 (4 pages).

Corbin, "Exit Device Functions", (pp. 13–14).

"Sargent", literature (2 pages).

"Russwin", literature (1 page).

"Yale Exit Devices", literature (1 page).

*Primary Examiner*—Richard E. Moore

*Attorney, Agent, or Firm*—William W. Haefliger

[57] ABSTRACT

Apparatus for transferring door opening or closing motion, in response to operation of a door handle, comprises: a mounting structure; first, second and third elements carried by the mounting structure for movement relative thereto, the first and third elements coupled to the second element, the second element carried for bodily movement in response to movement of the first element by the door handle, the third element being rotatable in response to bodily movement of the second element; a rotary output element connected to the third element; the second and third elements having alternative coupling positions characterized in that in one position the output element is rotated clockwise when the handle is operated in either direction, and in the other position the output element is rotated counterclockwise when the handle is operated in either direction; and the second element being in the form of a slider coupled to be displaced linearly by the first element when the handle is operated.

19 Claims, 9 Drawing Sheets

FIG. 15.
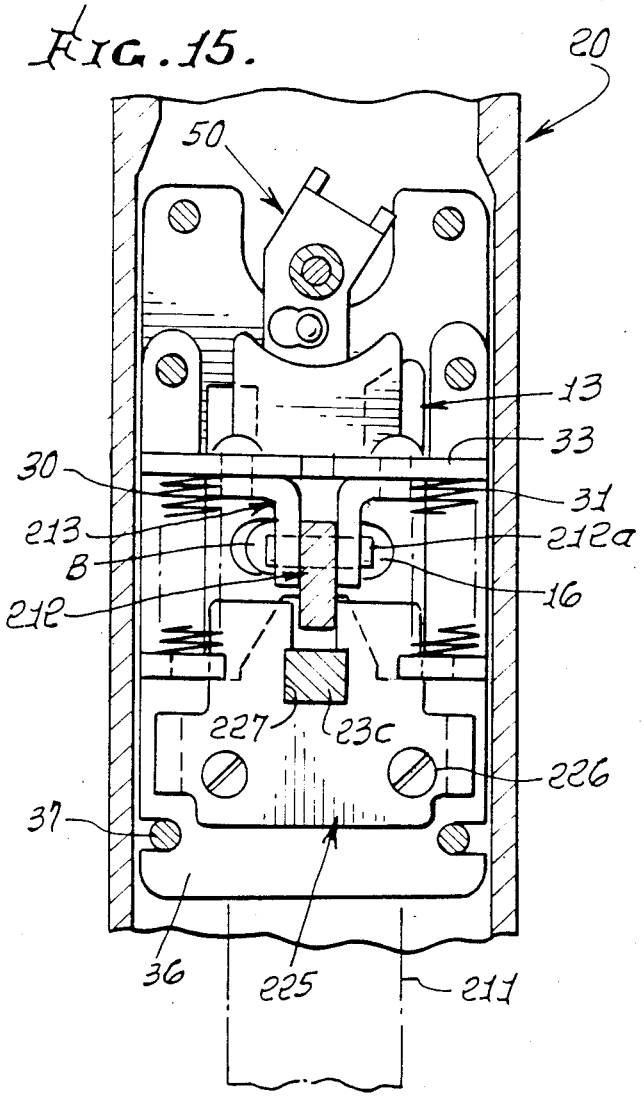
FIG. 17.
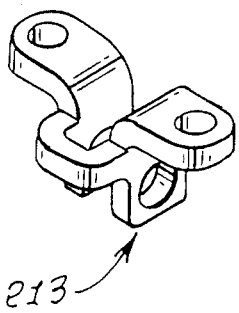
FIG. 18.
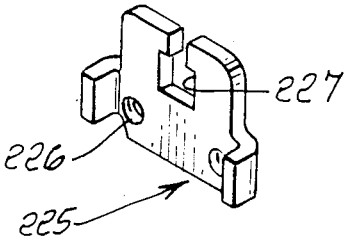
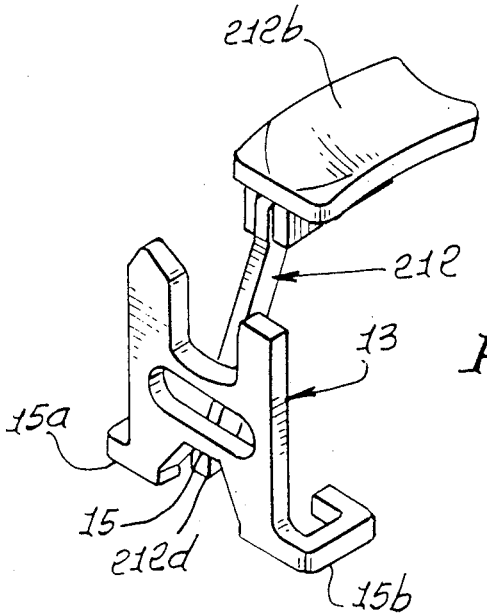
FIG. 16.

LEVER/KNOB ACTUATED ENTRY MECHANISM

BACKGROUND OF THE INVENTION

This application is a continuation-in-part of Ser. No. 382,414 filed July 20, 1989, which is a continuation-in-part of Ser. No. 286,178 filed Dec. 10, 1988 and now U.S. Pat. No. 4,915,432, issued Apr. 10, 1990. This invention relates generally to door latch actuators and, more particularly, to an improved actuator enabling installation in different configurations to enable opening of the latch when the door handle is installed to be swung either clockwise or counterclockwise, and when the handle is installed "right-handed" or "left-handed", to be swung in either direction, as will appear.

When door latch actuators carrying handles are installed, it may be necessary to produce either clockwise or counterclockwise rotation of the actuator output shaft, depending upon the installation; and it is desirable that a single actuator mechanism be usable for this purpose. Also, it is desirable that that same actuator mechanism be installable for either left or right handed operation. There is need for a simple, rugged, easily adjustable mechanism that is "universal" in its adaptability to any of the above modes of operation.

SUMMARY OF THE INVENTION

It is a major object of the invention to provide an improved latch actuating mechanism that is universal in its ability to be installed for operation in any of the above modes, i.e., to meet the above need. Basically, the mechanism of the invention includes:

(a) a mounting means, (b) first, second and third elements carried by the mounting means, for movement relative thereto, the first and third elements coupled to the second element, the second element carried for bodily movement in response to movement of the first element by the door handle, the third element being rotatable in response to bodily movement of the second element, (c) a rotary output element connected to the third element, (d) the second and third elements having alternative coupling positions characterized in that in one position the output element is rotated clockwise when the handle is operated (typically in either direction), and in the other position the output element is rotated counterclockwise when the handle is operated (typically in either direction), and (e) the second element being in the form of a slider.

It is another object of the invention to provide for connection of the first element to the handle, and for connection of the third element to an output element in the form of a rotary shaft. In this environment, it is another object to provide the second element in the form of a linearly movable slider having follower surfaces engageable with cam pins A and B, pin A carried by the first element to liftingly engage the slider, and pin B carried by the third element.

It is a further object to provide such follower surfaces to be parallel and to extend normal to the direction of linear movement of the slider. As will appear, each such follower surface ma include two sections, respectively at opposite sides of a plane bisecting the surfaces, at least one of the cam pins A and B being adjustably shiftable between the sections of its corresponding follower surface.

It is yet another object to provide a construction, as referred to, wherein the B pin is adjustably shiftable between the sections of its follower surfaces as formed by a groove, to reverse the direction of rotation of the rotary output element in response to rotation of the handle in a predetermined direction; and a further object is to provide a construction wherein the A pin is adjustably shiftable between the sections of its follower surfaces and in lifting relation with both of same, to permit usage of the handle on either side of the device.

A yet further object is to provide a locking part carried on the mounting means for movement into and out of locking position in which it blocks movement of one of the elements. As will be seen, the locking part typically blocks linear movement of th slider in the locking position, as well as having a retracted position in which it unblocks such slider movement. A further object is to provide an auxiliary handle in the form of an actuator lever which is pivotable to lift a lip thereby to displace the slider linearly, whereby the user's thumb may actuate the lever, to effect rotation of the output shaft.

These and other objects and advantages of the invention, as well as the details of an illustrative embodiment, will be more fully understood from the following specification and drawings, in which:

DRAWING DESCRIPTION

FIG. 1 is a perspective view of a mechanism incorporating the invention;

FIG. 1*a* is a diagrammatic view of the output shaft of the FIG. 1 mechanism, in door latch operating position;

FIG. 15 is a section taken on lines 15—15 of FIG. 14;

FIG. 16 is a perspective view of an actuator employed in FIG. 13;

FIG. 17 is a perspective view of an actuator bracket employed in FIG. 15;

FIG. 18 is a perspective view of a dummy bracket used in FIGS. 14 and 15.

DETAILED DESCRIPTION

Figure 13:
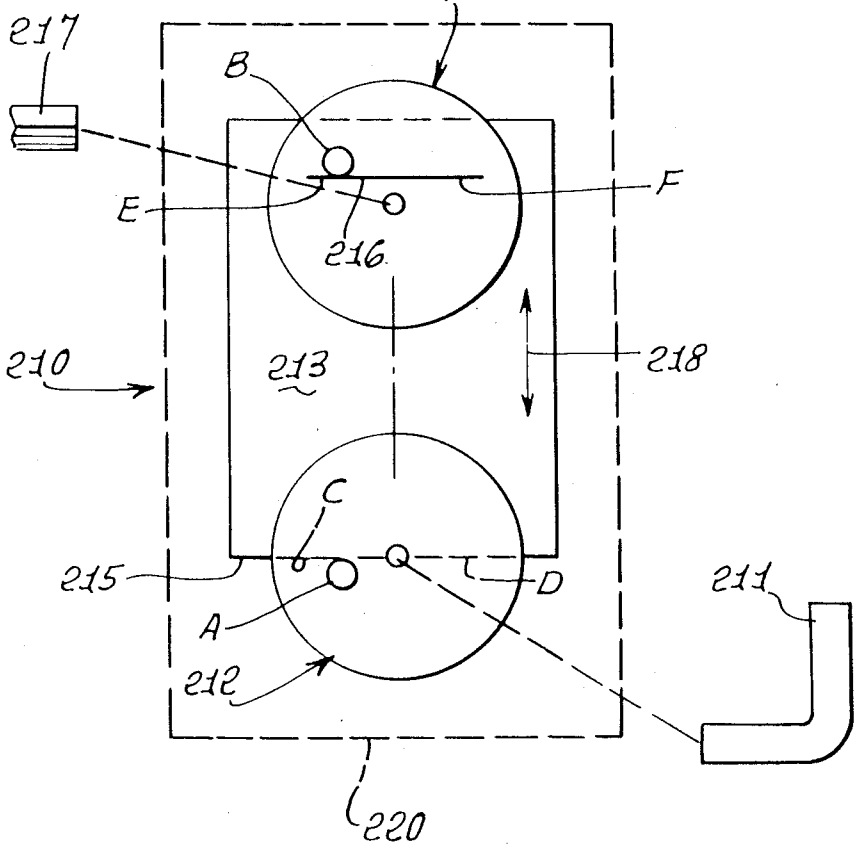
FIG. 13 is a diagrammatic view of basic elements.

Referring first to FIG. 13, the diagrammatic view of apparatus 210 for transferring door opening or closing motion, in response to rotation of a door handle 211, includes:

(a) a mounting means, indicated by the broken line block 220;

(b) first, second and third elements (212, 213 and 214 respectively) carried by the mounting means for movement relative thereto, the first element 212 coupled to the second element 213 (as for example by a lifter and cammed surface connection—pin A representing the lifter, and horizontal surface 215 on 212 representing the cammed surface); the third element 214 also coupled to the second element 213 (as for example by a tongue and groove connection—pin B representing the tongue and slot 216 in 214 representing the groove); the second element 213 carried for bodily movement (sliding) in direction of arrows 218 in response to lifting of a pin A (or equivalent) in response to movement of the first element 212 by the door handle; and the third element 214 being rotatable in response to bodily movement of the second element, as referred to;

(c) a rotary output element 217 connected to the third element 214;

(d) and at least two of the elements 212–214 having alternative coupling positions characterized in that in one of the latter the output element 217 is rotated clockwise when the handle is rotated clockwise (as in right-handed position), and in the other of the alternative coupling positions, the output element 217 is rotated counterclockwise when the handle is rotated counterclockwise (as in left-handed position). Referring now to the specific embodiment 10 shown in FIGS. 1–10 (other embodiments also being possible), the element-for-element correspondence with FIG. 13 is as follows:

| Element | FIG. 13 | FIGS. 1–10 |
|---|---|---|
| handle | 211 | 11 |
| mounting means | 220 (body) | 20 (body) |
| first element | 212 | 12 (drive rotor plate) |
| second element | 213 | 13 (slider or window block) |
| third element | 214 | 14 (driven rotor) |
| tongue | A (pin) | A (pin on rotor 12) |
| cammed surface | 215 | 15 |
| tongue | B (pin) | B (pin or rotor 14) |
| groove | 216 | 16 |
| rotary output element | 217 | 17 (shaft) |

In FIGS. 1–10, the body 20 is elongated, and face 22*a*, side walls 22*b* and 22*e*, and end has an outer walls 22*c* and 22*d*. The body is typically metallic and may be anodized. It may be attached to a door panel 85, as via connections 86. Attached to the handle is a shaft 23 including sections 23*a*, 23*b* and 23*c*. Section 23*a* fits within bearing 24 and section 23*b* fits within bore 24*a* in body 20 for rotation relative to the body as the handle is rotated.

The body 20 forms a recess 25 into which rotor or plate 12, slider (window) block 13 and rotor or plate 14 is received. Rotor 12 is attached at 26 to the end of drive shaft polygonal section 23*c* to rotate lifter pin A eccentrically relative to the shaft axis 27. Pin A projects under the bottom horizontal surface section 15*a* of bottom surface 15 of block or slider 13, the latter also defining a horizontal section 15*b* (see FIGS. 3 and 4), at the opposite side of a vertical plane 28 bisecting the surface 15 and block 13. Surface 15 is formed by slider (window) block 13 at the bottom thereof. Sections 15*a* and 15*b* may be referred to as C and D sections with which lifter pin A is associated.

Likewise, pin B, carried by driven rotor 14, projects into laterally elongated window groove 16 defining secondary cam surface sections 16*a* and 16*b* and also 16*a*' and 16*b*' (see FIGS. 3 and 4) at opposite sides of plane 28. Groove 16 is also formed by slider block 13, as a recess therein facing leftwardly in FIG. 2. Sections 16*a* and 16*b* may be referred to as E and F sections.

Figure 4:
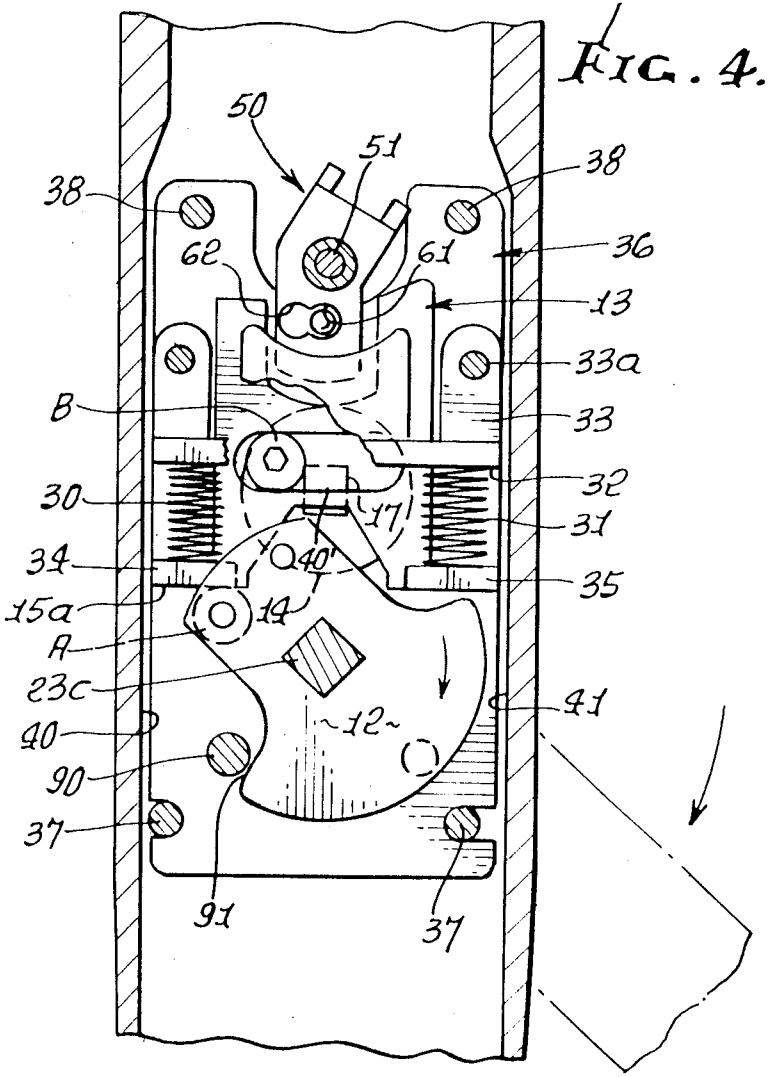
FIG. 4 is a view like FIG. 3 showing the position of elements after handle rotation.

Pin A functions as a primary cam, engaging one or the other of the primary cam follower surface sections C and D to displace the block 13 upwardly (see FIGS. 3 and 4) as the handle is rotated clockwise downwardly, as seen in FIG. 4; and pin B functions as a secondary cam follower, engaged by one or the other of the secondary cam surface sections E and F acting to displace pin B upwardly (see FIGS. 3 and 4) as the block is displaced upwardly by pin A. Such upward displacement of block 13 is resiliently or yieldably resisted by two compression springs 30 and 31 endwise confined between the undersurface 32 of a retainer 33 and ledges 34 and 35 on block 13. Those ledges form surfaces 15*a* and 15*b*. Retainer 33 is attached at 33*a* to a mounting plate 36 attached via fasteners 37 and 38 to body 20. Plate 36 extends in a plane parallel to the up-down movement of block 13, the latter slidably guided in its movement between plate 36 and plate or rotor 12, and also between body walls 40 and 41 seen in FIGS. 3 and 4. As the handle is rotated downwardly from FIG. 3 to FIG. 4 position, pin B is displaced upwardly to rotate the rotor 14 about is axis ', i.e., axis of output shaft 17, whereby pin B is also displaced laterally, from FIG. 3 to FIG. 4 position. As the handle is released, the springs act to return block 13 downwardly to FIG. 3 position, whereby the pins A and B also return to FIG. 3 position. Note that pin A is slidably confined against section 15*a*, and pin B between sections 16*b* and 16*b*' (the shaft 17 rotating 90°).

Figure 3:
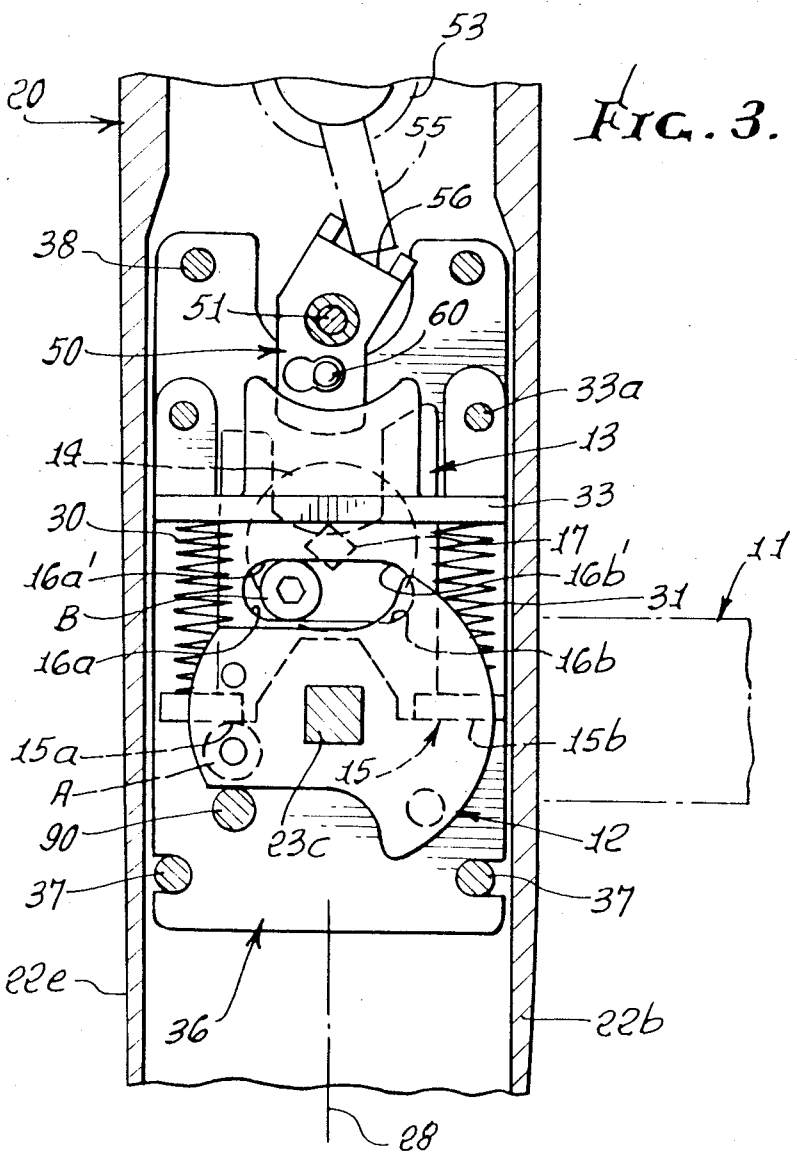
FIG. 3 is an elevation taken in section on lines 3—3 of FIG. 2.
Figure 10:
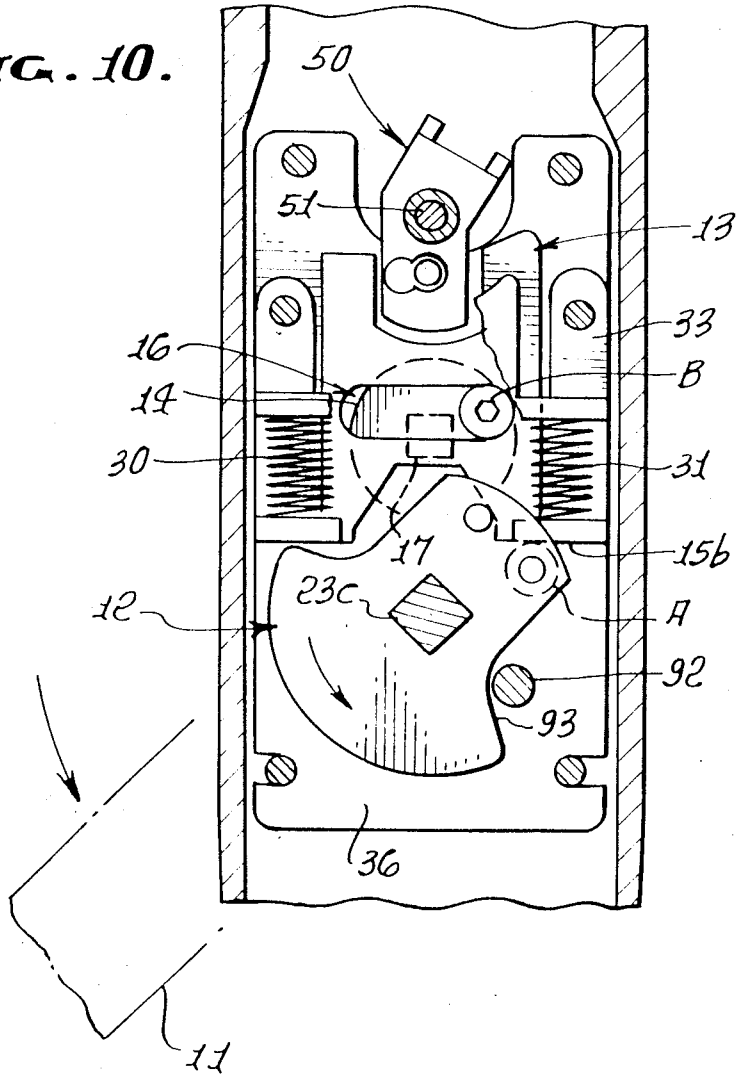
FIG. 10 is a view like 9 showing parts positioned after "left-handed" handle rotation, as to retract a door latch or bolt.
Figure 9:
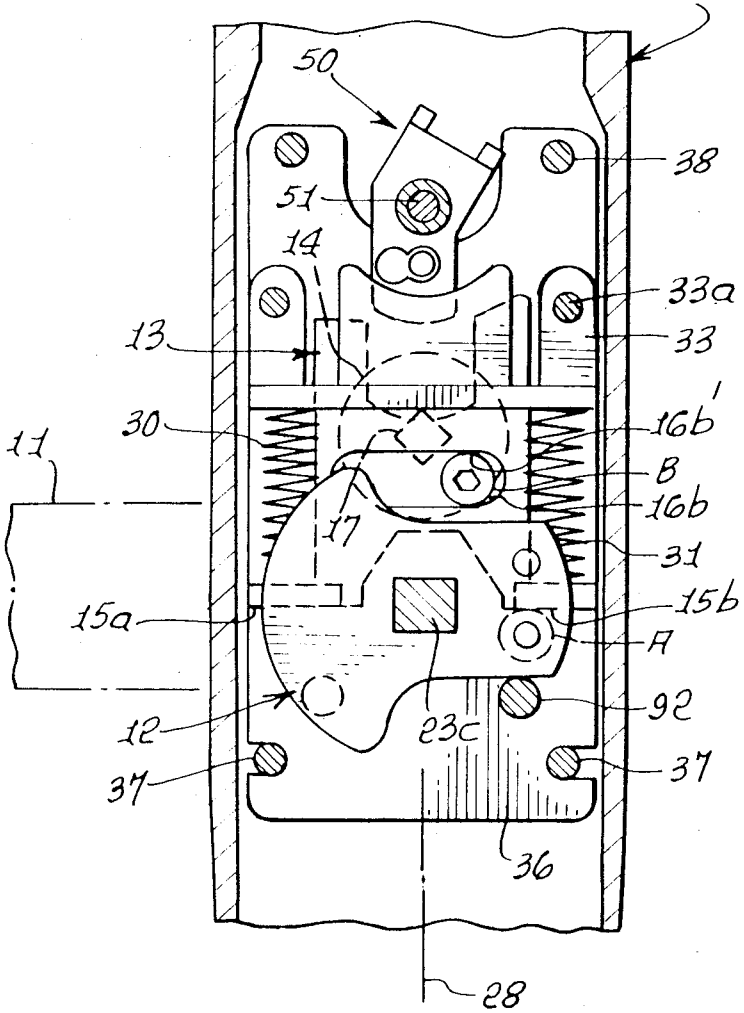
FIG. 9 is a view like FIG. 3 showing parts positioned for use when the handle is "left-handed" instead of "right-handed", as in FIG. 3.
Figure 14:
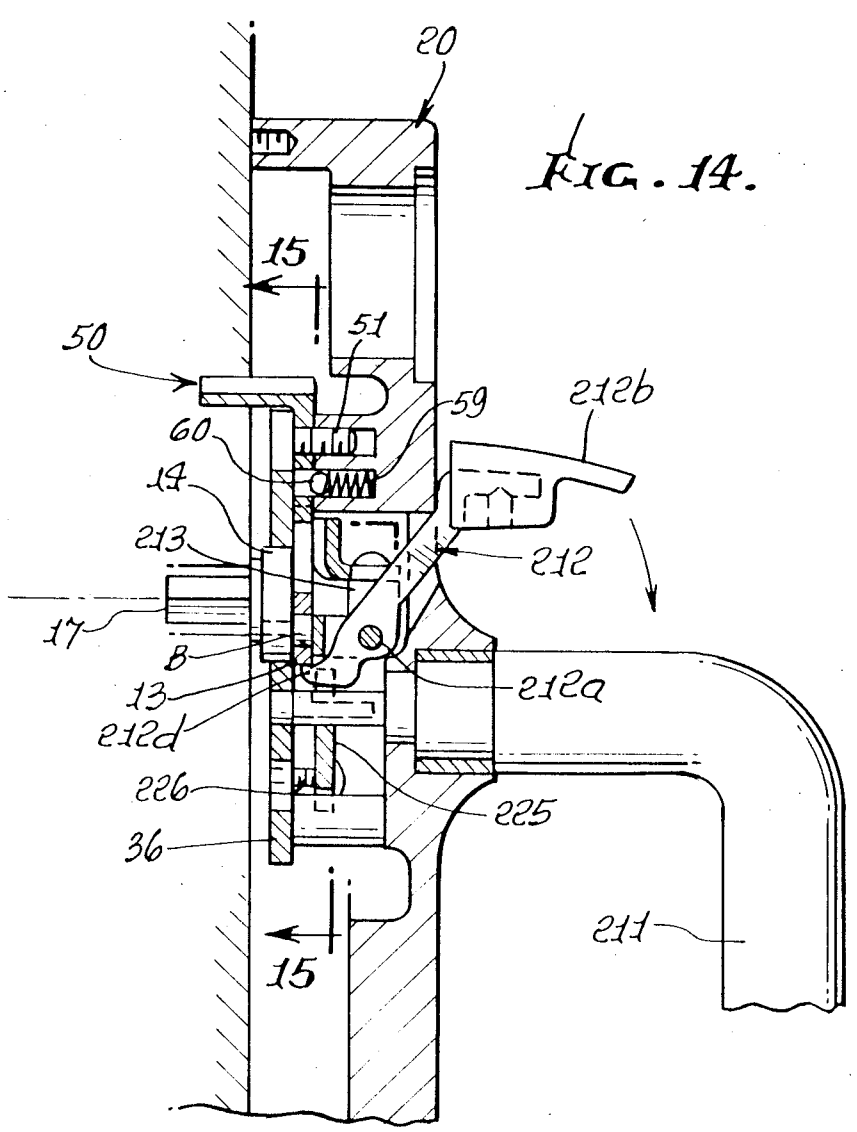
FIG. 14 is a view like FIG. 12 showing another version of the invention using an additional actuator.
Figure 12:
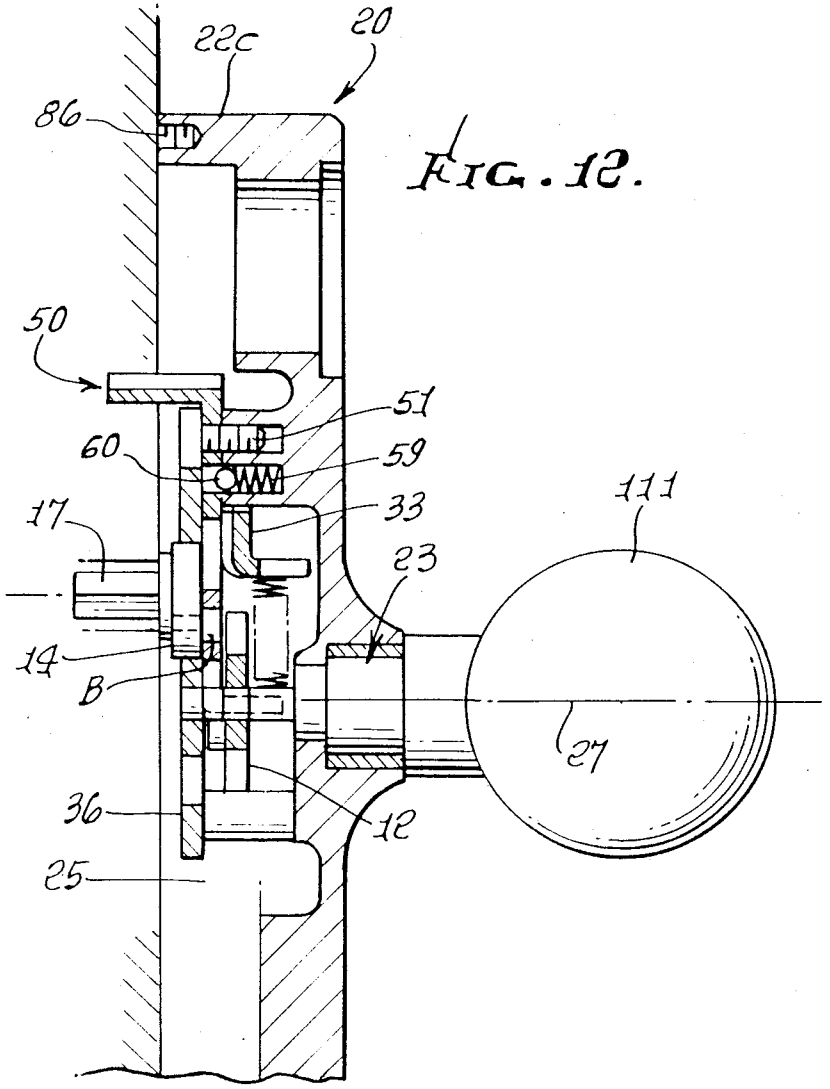
FIG. 12 is an elevation taken in section on lines 12—12 of FIG. 11.

In the above description, the handle is to be rotated downwardly and clockwise (FIGS. 3 and 4). The invention also enables rotation of the handle downwardly and counterclockwise, to open the door, and for this purpose the parts may be installed as in FIGS. 9 and 10, which corresponds to FIGS. 3 and 4, but differ in the confinement of lifter pin A against surface 15*b* instead of against surface 15*a* likewise, pin B remains between surfaces 16*b* and 16*b*' during pin A movement, as seen in FIGS. 9 and 10. The parts are simply selectively installed in the position, relative to plane 28 that correspond to the desired direction of handle displacement or turning, as shown. For this purpose, plate 12 is endwise reversed 180° (as between FIGS. 3 and 9). Note that the groove 16 and surface 15 extend in parallel and normal to the up-down direction of handle movement of the slider block 13.

Figure 1A:
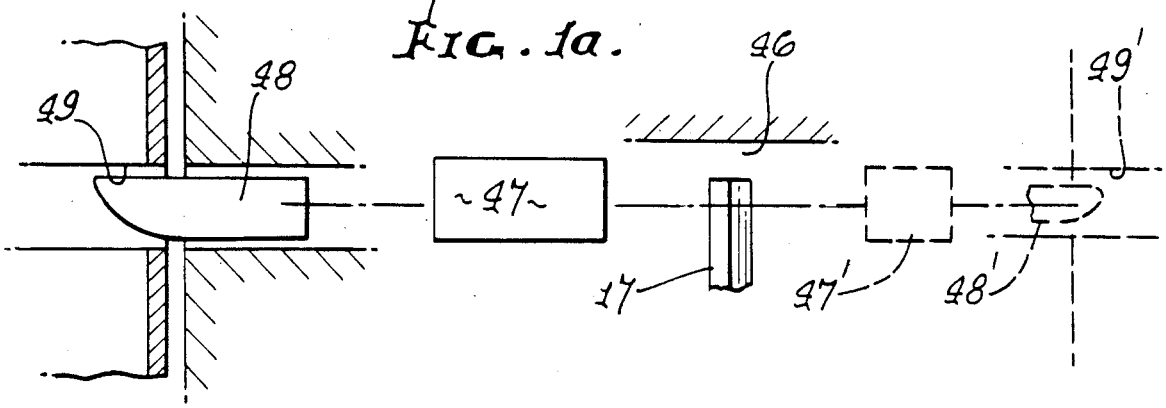
Figure 2:
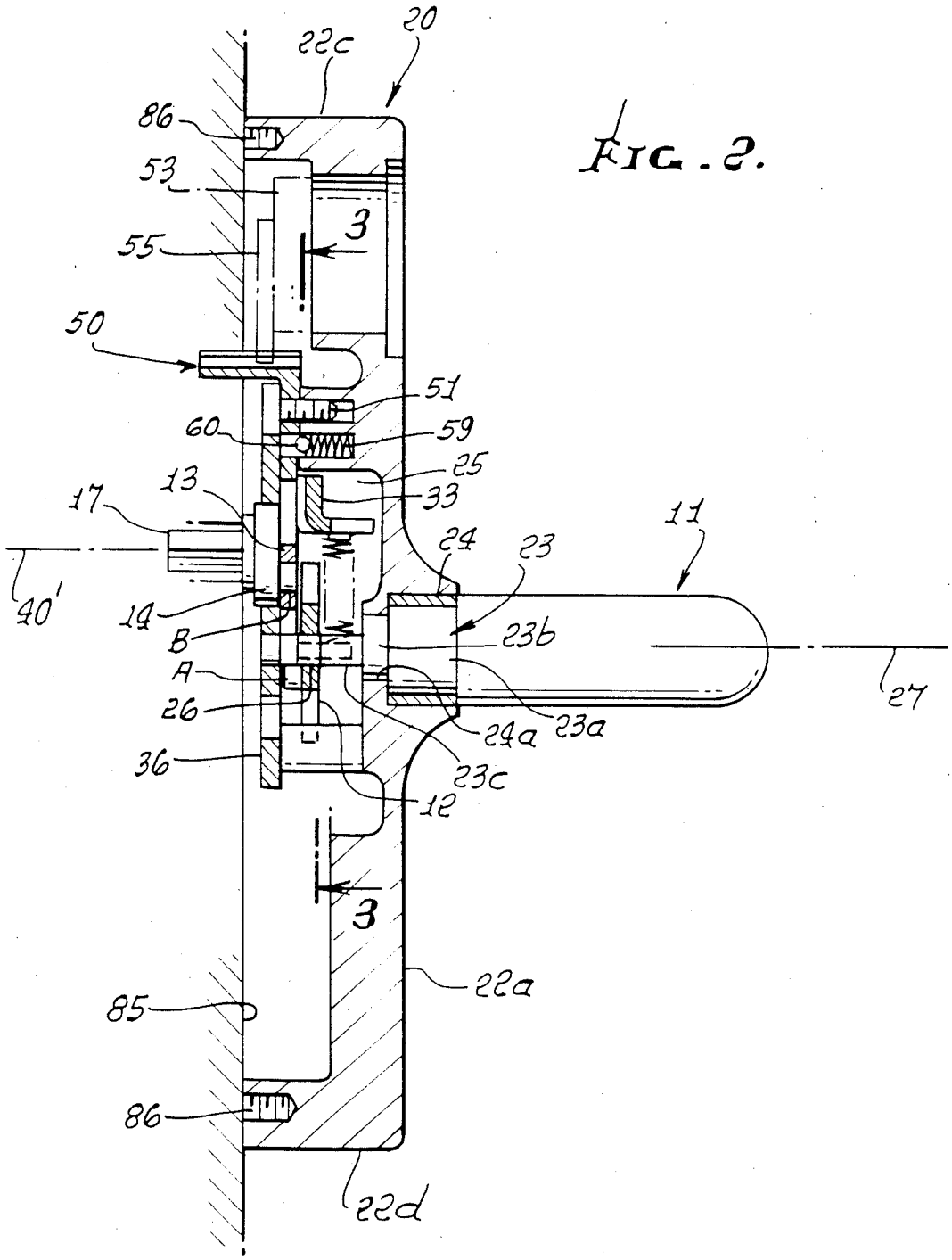
FIG. 2 is an enlarged vertical elevation, in section on lines 2—2 of FIG. 1.

FIG. 1*a* shows the output shaft 17 which rotates in a door recess 46 to operate mechanism 47 that in turn retracts bolt or latch 48 rightwardly from keeper 49. Different arrangements of such latches and keepers are of course possible. If the handle 11 is installed to rotate in the opposite direction, a latch 48' can be retracted leftwardly from a keeper 49', as via mechanism 47'.

Figure 5:
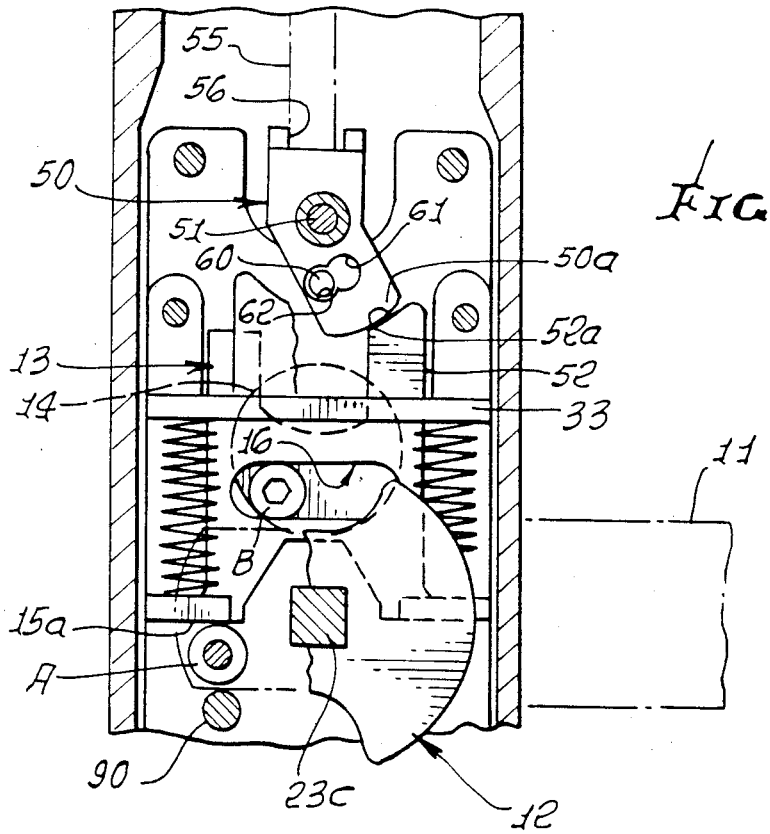
FIG. 5 is a view like FIG. 3 showing elements in locked position.
Figure 6:
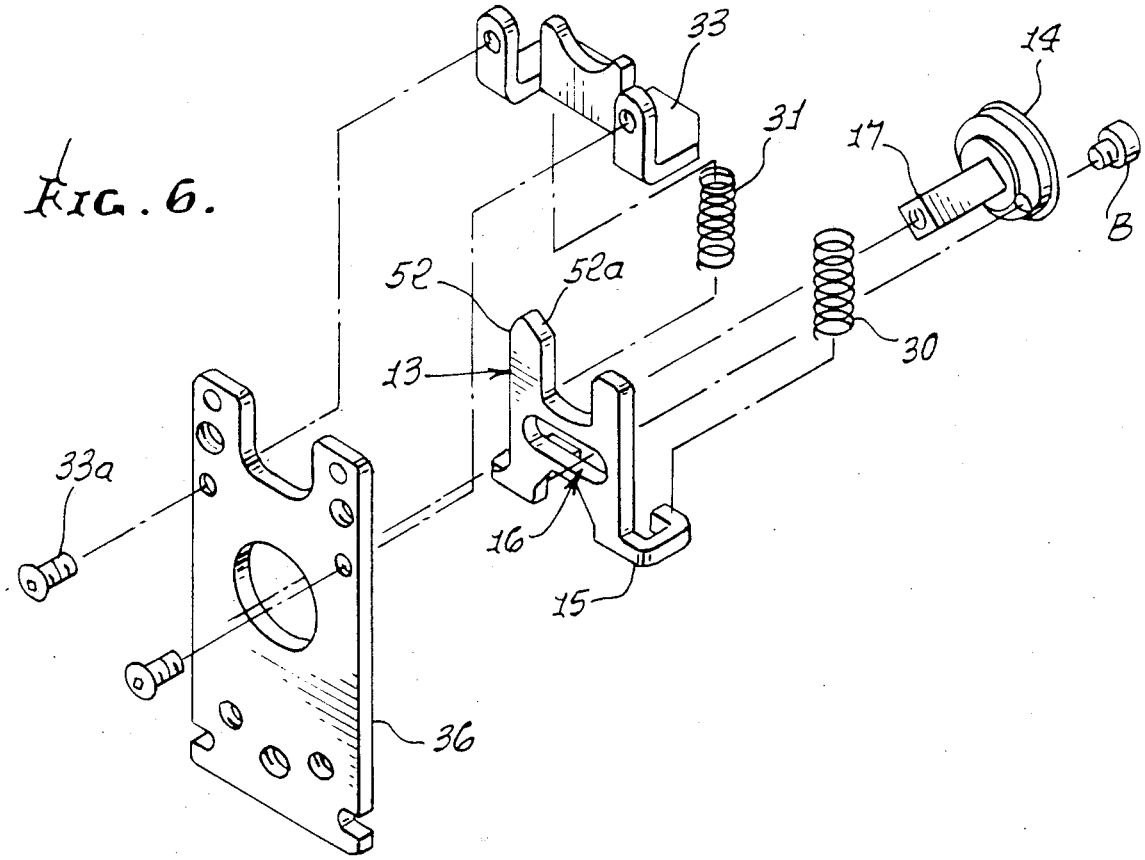
FIG. 6 is an exploded view of certain elements of the FIGS. 1–5 mechanism.
Figures 7, 8:
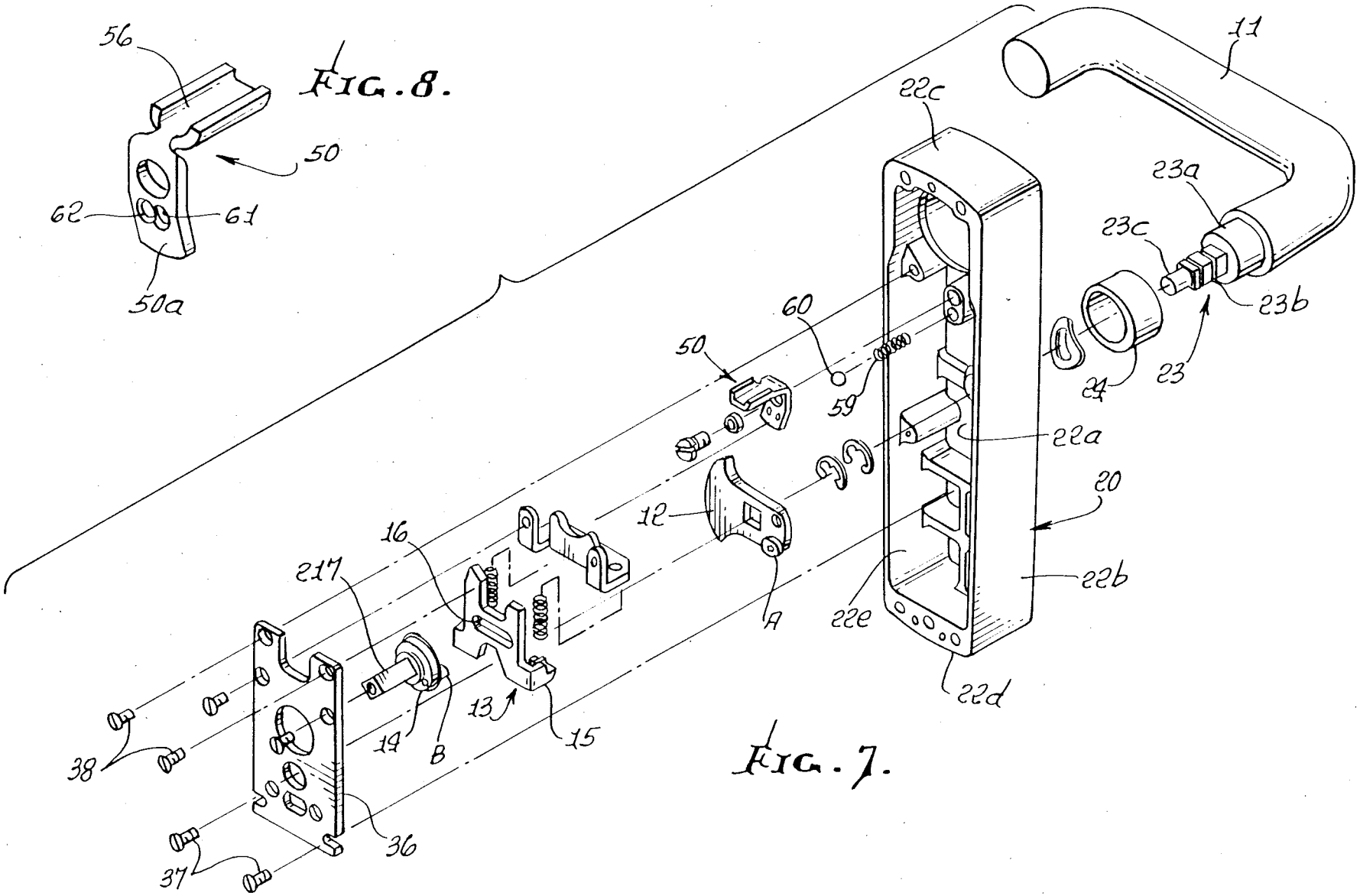
FIG. 7 is an exploded view showing all of the parts of the FIGS. 1–6 mechanism.
FIG. 8 is a perspective view showing a lock arm.

Also, provided is a locking part carried on mounting structure (as for example body 20) for movement into and out of locking position, wherein it blocks movement of one of the elements 12, 13 and 14. In the example shown in FIGS. 3, 4 and 5, the locking part is shown in the form of an arm 50 pivoted at 51 to the body 20. When pivoted into locking position as seen in FIG. 5, the arm lower convex end **50*a* engages a flat 52*a* at the upper edge of an upward projection 52 on the slider block 13, preventing sliding of that plate and thereby inhibiting rotation of the handle Arm 50 is rotatable into that position by rotation of a lock rotor 53, as by means of a key inserted and accepted into a key slot 54 in that rotor (see FIG. 1). A dog 55 on that rotor is received into a recess 56 in the upper end of the arm 50 to rotate the arm as rotor 53 is turned. When the arm is rotated into unlocking position, as seen in FIGS. 3 and 4, the drive rotor plate 12 is unblocked and may be displaced (lifted) by the handle. A spring urged detent ball 60 in body 20 is accepted in one or the other of the notches 61 and 62 in the arm 50 when the arm arrives at one or the other position, as seen in FIGS. 3 and 5, for arm locating purposes. See spring 59 in FIG. 2. As referred to, FIGS. 9 and 10 correspond to FIGS. 3–5, respectively, and show parts positioned or installed (using the same mechanism) for "left-handed" handle 11 positioning operation, instead of "right-handed" operation. Note in FIG. 4 that a stop pin 90 on plate 36 is engageable by concave surface 91 of plate 12 to limit handle rotation in one direction. In FIG. 10, a stop pin 92 on plate 36 is engageable by concave surface 93 of plate 12 to limit handle rotation in the opposite direction. In FIGS. 3 and 5, pins 90 on the plate 36 limit counterclockwise rotation of the plate 12**.

Also contemplated is a tool having a polygonal opening to be received ove the polygonal cross-section output shaft 17 for rotating it and rotor 14 through a predetermined angle, such as 270° to shift pin B from FIG. 3 position to FIG. 9 position, whereby the direction of rotation of the output shaft 17 is reversed when the handle is turned. For example, note the following:

TABLE

| | FIG. 3 | FIG. 9 |
|---|---|---|
| direction of rotation of handle 11 | clockwise | counter-clockwise |
| direction of rotation of shaft 17 | clockwise | counter-clockwise |

This feature accommodates the device, universally, to different latch retraction arrangements as found in different latching hardware on doors.

Figure 1:
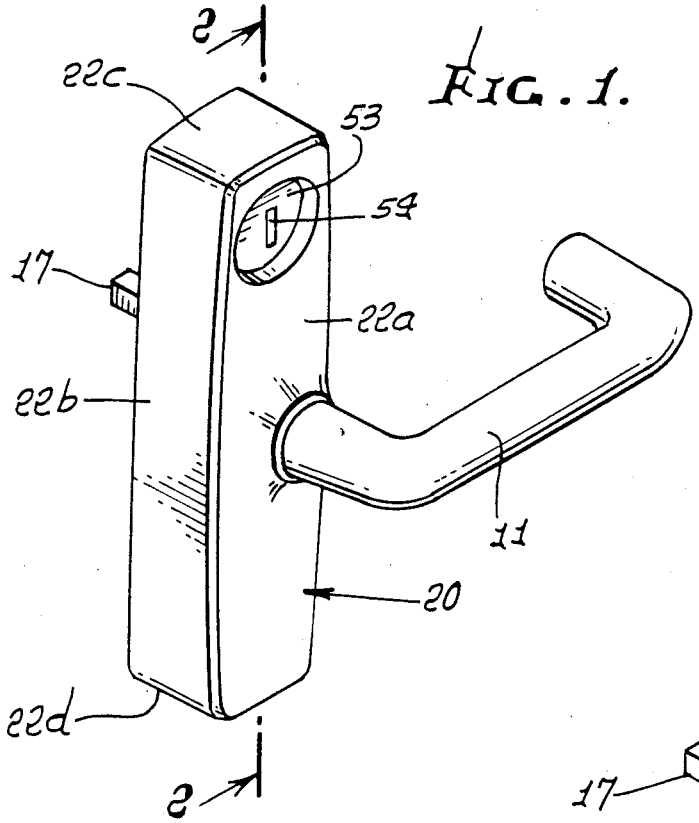
Figure 11:
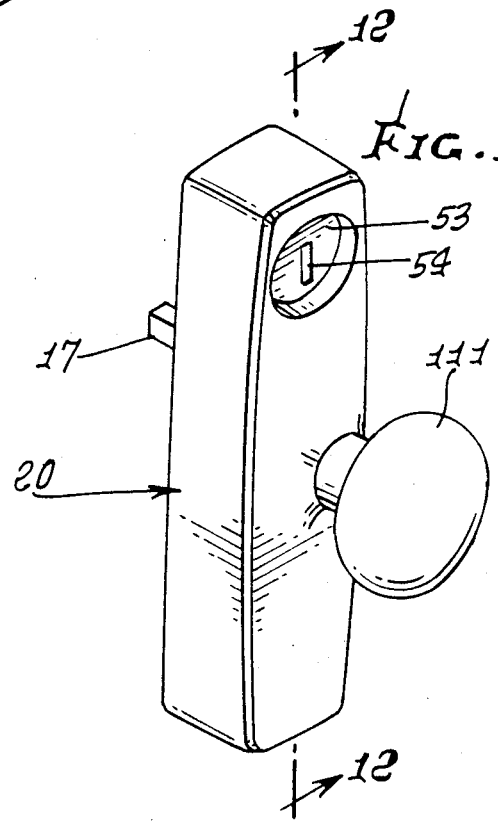
FIG. 11 is a view like FIG. 1 but showing a doorknob version of the invention.

FIG. 11 is like FIGS. 1–10 except that the handle 11 is replaced by a knob 111 which may be rotated (manually) about axis 27, as is handle 11.

In FIGS. 14–18, the primary handle 211 is not rotatable about a handle axis to effect rotation of the output shaft 17. Also, driver plate 12 is omitted. Instead, an auxiliary handle in the form of an actuator 212 is provided to be depressed at **212*b* by the user's thumb, while his fingers grasp the non-rotating handle 211. Actuator 212 is in the form of a lever, pivoted at pin 212*a* on a bracket 213 attached to the retainer 33, so as to rotate about a horizontal axis parallel to the plane of slider 13 when outwardly projecting thumb piece 212*b* is depressed. The opposite end of the lever carries a lip 212*d* (first element) which bears against the undersurface 15 of the window block (slider). Thus, clockwise rotation of the actuator lever 212 in FIG. 14 effects lifting of the window block 13 to rotate shaft 17; and when the lever is released, the springs 30 and 31 lower window block 213 and return the lever to FIG. 14 position. Handle 211 provides a fixed grip to be gripped manually when lever 212** is pivoted.

A "dummy" bracket 225 is attached at 226 to the plate 36 and blocks rotation of handle 211. Note the polygonal opening 227 in the bracket, in FIG. 18, that receives the corresponding polygonal end of the handle shaft.

Figure 19:
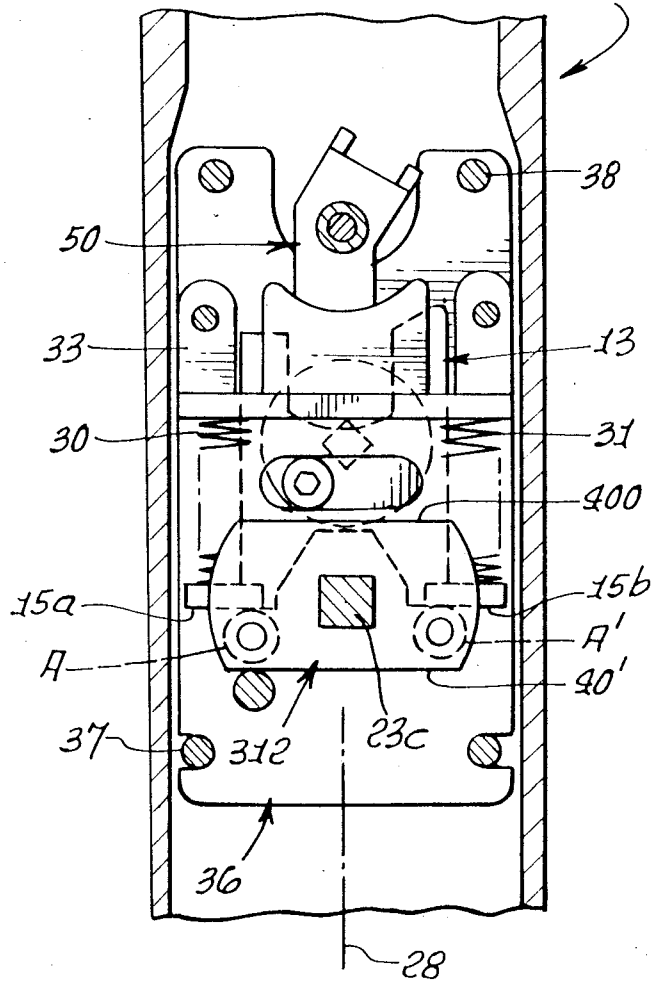
FIG. 19, is a view like FIG. 3 but showing a modification.

In FIG. 19, the parts are generally the same as in FIG. 3, and therefore bear the same numerals with the following exceptions: the drive plate 312 (corresponding to plate 12) does not have "ears" or lobes with surfaces 91 and 93, but rather its opposite edges 400 and 401 are parallel. Also, it has an added pin A' corresponding to pin A but at the opposite (revised surface related) side of axis or plane 28. Pin A' underlies surface **15*b*, just as pin A underlies surface 15*a*. Thus, if rotor plate 312 is rotated in one direction, pin A lifts 15*a* and slider 13; whereas if plate 312 is rotated in the opposite direction, pin A' lifts 15*b* and slider 13**.

We claim:

1. In apparatus for transferring door opening or closing motion, in response to operation of a double handle, the combination comprising:

(a) a mounting means, (b) first, second and third elements carried by the mounting means, for movement relative thereto, the first and second elements coupled to the second element, the second element carried by said mounting means for bodily movement in response to movement of the first element by the door handle, the third element being rotatable in response to bodily movement of the second element, (c) a rotary output element connected to the third element, (d) the second and third elements having alternative coupling positions characterized in that in one position the output element is rotated clockwise when the handle is operated, and in the other position the output element is rotated clockwise when the handle is operated, (e) the second element being in the form of a slider coupled to be displaced linearly by the first element when the handle is operated, (f) and wherein the first and second elements have primary cam and cam follower surfaces, and the second and third elements having secondary cam and cam follower surfaces, the primary cam follower surface having C and D sections and the secondary cam surface having E and F sections, the primary cam engaging the C section and the secondary cam follower engaging the E section when the handle is to be rotated clockwise, and the primary cam engaging the D section and the secondary cam follower engaging the F section when the handle is to be rotated counterclockwise.

2. The combination of claim 1 including a locking part carried on the mounting means for movement into and out of locking position in which it blocks movement of one of said elements.

3. The combination of claim 2 wherein the locking part blocks linear movement of the slider in said locking position.

4. The combination of claim 3 wherein there are stop means limiting movement of the first element to thereby limit movement of the slider.

5. The combination of claim 1 wherein said second element is carried for linear movement by said mounting means.

6. The combination of claim 5 including spring means urging said second element in a direction to yieldably oppose movement of the first element by the handle.

7. The combination of claim 1 wherein the first element is connected with the handle to be rotated thereby, and the third element is connected with the rotary output element in the form of a shaft, to rotate the shaft.

8. In apparatus for transferring door opening or closing motion, in response to operation of a door handle, the combination comprising:

(a) a mounting means, (b) first, second and third elements carried by the mounting means, for movement relative thereto, the first and third elements coupled to the second element, the second element carried for bodily movement in response to movement of the first element by the door handle, the third element being rotatable in response to bodily movement of the second element, (c) a rotary output element connected to the third element, (d) the second and third elements having alternative coupling positions characterized in that in one position the output element is rotated clockwise when the handle is operated, and in the other position the output element is rotated clockwise when the handle is operated, (e) the second element being in the form of a slider coupled to be displaced linearly by the first element when the handle is operated, (f) and wherein the first element is connected with the handle to be rotated thereby, and the third element is connected with the rotary output element in the form of a shaft, to rotate the shaft, (g) also wherein the slider has surfaces engageable by pins A and B, pin A carried by the first element and pin B carried by the third element.

9. The combination of claim 8 wherein said slider surfaces are parallel and extend normal to the direction of linear movement of said slider.

10. The combination of claim 9 wherein the surface includes two sections, respectively at opposite sides of a plane bisecting the surfaces, at least one of the pins A and B being adjustably shiftable between the sections of its corresponding slider surface.

11. The combination of claim 10 wherein the B pin is adjustably shiftable between the sections of its corresponding slider surface to reverse the direction of rotation of the rotary output element in response to rotation of the handle in a predetermined direction.

12. The combination of claim 10 wherein the A pin is adjustably shiftable between the sections of its corresponding slider surface to maintain the upward motion thus imparted by handle via the first element and pin A to the slider when the direction of rotation of the handle is reversed.

13. The combination of claim 1 wherein the second element is movable longitudinally linearly, the surfaces C, D, E, and F are carried on the second element, the C and D surfaces offset laterally and extending laterally, and the E and F surfaces offset laterally and extending laterally.

14. The combination of claim 1 wherein the handle has L shape.

15. The combination of claim 1 wherein the handle is a knob.

16. The combination of claim 1 wherein the handle includes an actuator lever pivotably carried by the mounting means, the lever having a cam lip engaging a cam follower surface of the slider.

17. The combination of claim 16 wherein the handle also includes a fixed grip carried by the mounting means and adapted to be gripped manually when the actuator lever is pivoted.

18. The combination of claim 8 wherein slider has another surface engageable by pin A', pin A' also carried by the first element, and further characterized in that when the first element is rotated in one direction, pin A displaces the slider in a predetermined direction; and when the first element is rotated in the opposite direction, pin A' displaces the slider in said predetermined direction.

19. The combination of claim 18 pins A and A' are at opposite sides of a plane passing through an axis of rotation of said first element and extending in said predetermined direction, said slider having follower surfaces thereon engageable by A and A'.

* * * * *